United States Patent [19]

Gibbs

[11] 4,198,105

[45] Apr. 15, 1980

[54] ADJUSTABLE CARD HOLDER

[75] Inventor: Bronwen Gibbs, Somers, Australia

[73] Assignee: Modern Office Equipment Pty. Ltd., Victoria, Australia

[21] Appl. No.: 936,895

[22] Filed: Aug. 25, 1978

[30] Foreign Application Priority Data

Aug. 26, 1978 [AU] Australia ..... PD1416

[51] Int. Cl.[2] ..... A47F 7/00

[52] U.S. Cl. ..... 312/183; 312/185; 211/50

[58] Field of Search ..... 312/183, 184, 185, 186, 312/187, 190, 294, 271; 211/50, 126, 11

[56] References Cited

U.S. PATENT DOCUMENTS

| | | | |
|---|---|---|---|
| 410,257 | 9/1889 | Smith, Sr. | 211/50 |
| 1,108,893 | 9/1914 | Ellinwood | 312/271 |
| 1,838,681 | 12/1931 | Hutchings | 211/50 |
| 2,073,832 | 3/1937 | Dalkowitz | 211/50 |
| 2,829,651 | 4/1958 | Loring | 211/50 |
| 3,017,232 | 1/1962 | Schwab et al. | 312/183 |
| 3,696,926 | 10/1972 | Syversen | 312/183 |
| 4,005,797 | 2/1977 | Ingram | 312/183 |

FOREIGN PATENT DOCUMENTS

| | | | |
|---|---|---|---|
| 2155505 | 5/1973 | Fed. Rep. of Germany | 312/183 |
| 1203793 | 9/1970 | United Kingdom | 312/183 |

*Primary Examiner*—Victor N. Sakran

*Attorney, Agent, or Firm*—Cushman, Darby & Cushman

[57] ABSTRACT

An adjustable holder for flat articles such as cards. The holder comprises a frame which has a longitudinal member and two transverse members, arranged in an H shape. At each end of the longitudinal member a bracket is located. A first plate is mounted on one bracket for limited pivotal movement about a horizontal plane. A second plate is adjustably mounted on the longitudinal member for movement between the first plate and the other bracket. Flat articles are stored between the two plates. Side rails are adjustably mounted on the transverse members parallel to the longitudinal member, to restrain lateral movement of the flat articles.

10 Claims, 4 Drawing Figures

ADJUSTABLE CARD HOLDER

BACKGROUND OF THE INVENTION

This invention relates to an adjustable holder for receiving, containing and storing flat articles, in particular cards such as ledger cards.

Existing adjustable card holders or card posting trays are relatively expensive and elaborate in construction, and/or are not easily or quickly adjustable to take cards of different shapes or sizes, and consequently such devices have only limited usefulness and are not satisfactory for the purposes for which they are designed.

SUMMARY OF THE INVENTION

In view of the foregoing it is an object of this invention to provide an improved adjustable holder which is relatively inexpensive to manufacture, which can be quickly and easily adjusted to receive and store flat articles of a relatively large number of different sizes and shapes, and which is therefore suitable for use for a variety of purposes at minimal cost. The device of the invention is also durable and effective in use, and convenient to operate.

A further object is to provide a holder which can be readily disassembled and reassembled thus facilitating storage and transport.

More particularly, an adjustable holder constructed according to the invention may comprise a frame, at least portion of which is adapted to support flat articles against movement in a vertical plane, a first bracket and a second bracket mounted on said frame said brackets being spaced, a first plate mounted on said bracket for limited motional movement about a generally horizontal plane, a second plate mounted on said frame for movement between said first plate and said second bracket, and side rails adjustably mounted on said frame for restraining lateral movement of flat articles.

The term "flat articles" is used in this specification to refer to flat or substantially flat articles of paper, board, plastic or any other material, of rectangular or other shape, and refers particularly to cards which require to be stored in a manner in which they can be readily inspected, removed, and replaced, and which can be held either loosely or clamped firmly together, as required.

DETAILED DESCRIPTION

Figure 1:
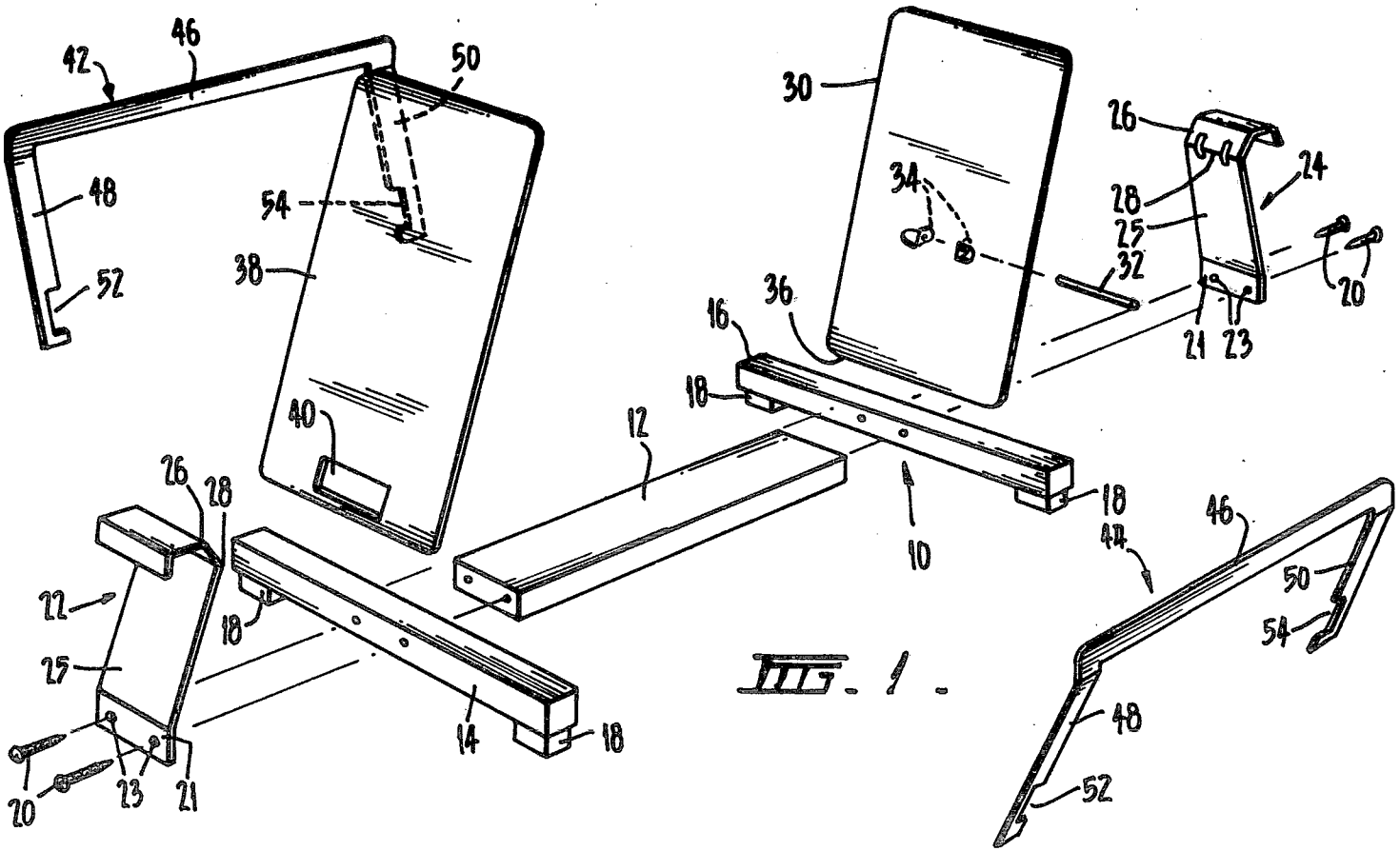
FIG. 1 is an exploded view of one embodiment of card holder.
Figure 2:
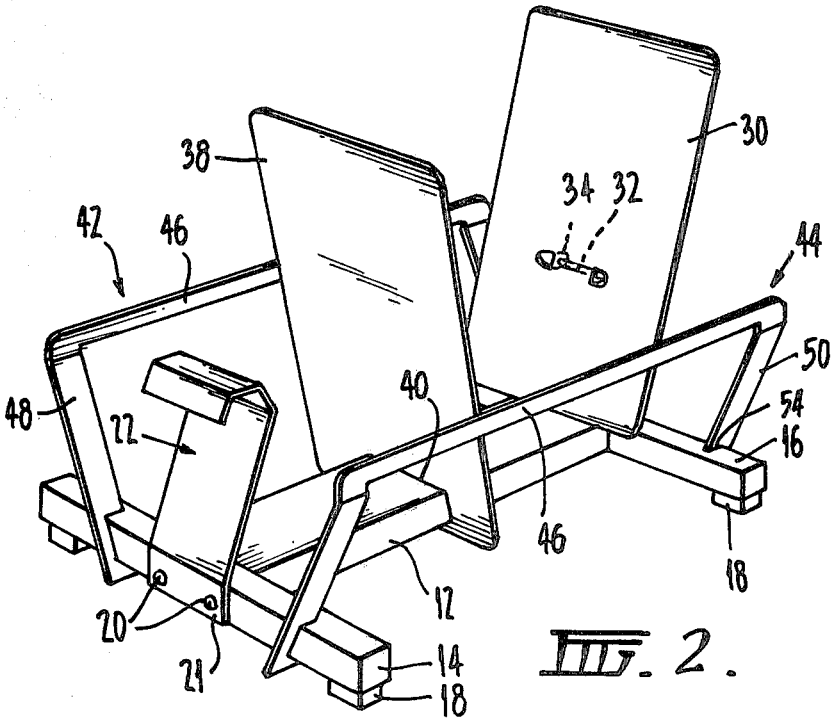
FIG. 2 is a perspective view of the card holder of FIG. 1.
Figure 3:
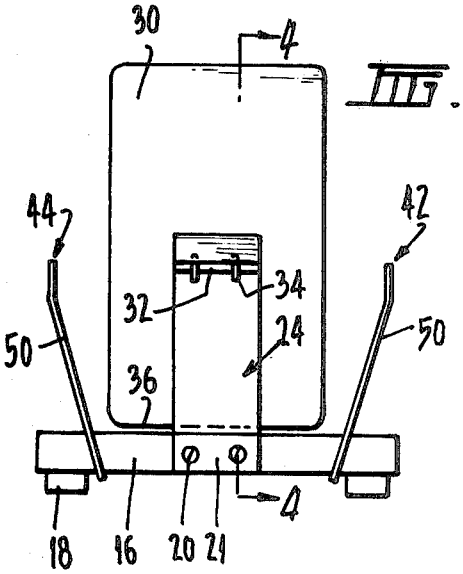
FIG. 3 is a rear end view of the card holder of FIG. 1.

Referring to the drawings, the reference numeral 10 indicates the frame of the card holder, which comprises a longitudinal member 12 connected at its ends to two transverse members 14, 16 each of which is provided with legs 18 at each end whereby the members 12, 14 16 are raised by a suitable distance above the surface on which the device is place.

The members 12 14 16 are preferably of rectangular cross-section and formed of metal, but it will be understood that they may be of circular, oval, triangular, hexagonal, or of any other cross-section, and that they and the other components of the device may be formed of plastic, wood, or any other suitable material. The legs 18 may be formed from rubber or other suitable material, and may be formed integral with the members 14, 16.

The transverse members 14, 16 are conveniently secured at or about their centres to the ends of the longitudinal member 12 by screws 20, but they may be secured together in any suitable manner, or may be formed integrally with the longitudinal member 12, but are preferably detachable therefrom as herein described so that the device may be readily disassembled for storage and transport and reassembled when required for use.

A pair of brackets 22, 24 are secured at their lower portions 21 by apertures 23, through which the screws 20 pass, to the transverse members 14, 16 respectively at opposite ends of the longitudinal member 12, and these brackets are shaped such that an intermediate portion 25 inclines inwardly and upwardly, and the upper portions 26 are turned outwardly so as to form inner abutments 28. The brackets 22, 24 are preferably formed of flexible, elastic material, such as spring metal for the purpose hereinafter described.

A support plate 30 is hinged at or about its centre to the bracket 24 as by means of a horizontal rod or bar 32 secured to the outer face of the plate 30 and passing through one or more brackets 34 attached to the plate 30 so that the plate 30 may pivot about a horizontal axis coinciding with the bar 32. The plate 30 is generally rectangular and its lower edge 36 is spaced slightly above the upper face of the longitudinal member 12 to permit tilting of the plate 30 between a first position where it abuts portion 25, and a second portion where it abuts upper portion 26.

A second movable plate 38 of rectangular shape is slidably and tiltably mounted on the longitudinal member 12. This is accomplished by forming the plate 38 with a rectangular aperture 40 near its lower end which fits over the longitudinal member 12 and is slidable therealong. The height of the aperture 40 is slightly greater than that of the longitudinal member 12 so that the plate 38 may be tilted between two extreme positions, its tilting movement in each direction being limited and arrested when the upper and lower edges of the aperture 40 in the plate 38 engage and lock against the top and bottom faces of the longitudinal member 12. The lateral length of the aperture 40 in the plate 38 is sufficiently greater than the width of the longitudinal member 12 to permit the plate 38 to be moved easily and smoothly along the member 12 without any appreciable sideways tilting or lateral movement. The top edge of the plate 38 is located at substantially the same height above the member 12 as that of the plate 30.

A pair of side rails 42, 44 are mounted on the transverse members 14, 16 so as to be capable of lateral movement therealong and also of being locked in any desired position therealong. Each of the side rails 42, 44 comprises a horizontal member 46 and two downwardly extending end members 48, 50. The lower ends of the end members 48, 50 are provided with slots 52, 54 which are open at their inner ends and which fit over the transverse members 14, 16. As in the case of the plate 38, each of the slots is preferably rectangular and is so shaped that its height is slightly greater than that of the transverse member 14, 16 on which it fits, so that the end members 48, 50 (and the rails 42, 44 may be moved slidably along the members 14, 16 and may be tilted between two extreme inclined positions. Thus each side rail 42, 44 may be moved inwardly or outwardly along the transverse members 14, 16 and then locked in position by tilting the end members 48, 50 outwardly in opposite directions until the upper and lower edges of the slots 52, 54 lock against the top and bottom faces of the transverse members 14, 16 respectively and further outward movement of the rails 42, 44 is prevented.

The horizontal members 46 of the side rails 42, 44 are bent at an angle to the end portions 48, 50 so that the members 46 are substantially vertical to engage the vertical side edges of the cards.

Figure 4:
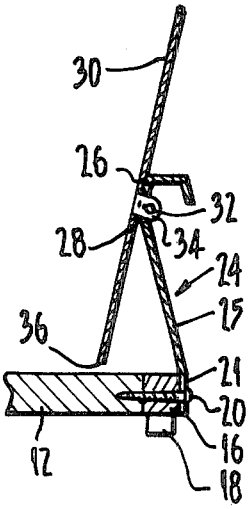
FIG. 4 is a section along the lines 4—4 of FIG. 3.

If it is desired to use the adjustable card holder of this invention for storing cards, the support plate 30 is tilted so as to incline upwardly and outwardly as shown in FIG. 4 and the cards are placed so as to rest against the inner face of the plate 30 with their lower ends resting on the longitudinal member 12. Any desired number of cards may be placed in this position. The movable plate 38 is then moved along the member 12 to the required position so that the cards are located between the plates 30 and 38.

It it is desired to clamp the card firmly between the plates 30 and 38, the plate 38 is pushed towards the plate 30 so as to compress the cards (not shown) between the plates 30 and 38, the plate 30 being moved to a position where it is parallel to portion 25 in contact with the bracket 16. By this means the air between the cards and between the cards and the plates may be expelled and consequently burning or destruction of the cards in the event of fire is prevented.

Additional compression of the cards may be achieved by making the bracket 24 of spring steel or similar material so that as the plate 38 is moved towards plate 30, the bracket 24 is flexed outwardly thereby increasing the compression of the cards.

When it is desired to release the cards from the holder, the upper end of the movable plate 38 is pushed so as to release the clamp on the cards caused by the plate 38 gripping on the member 12 and thereby allowing the plate 38 to be moved away from the cards and tilted about the member 12.

The plate 38 may then be rocked back from the position generally parallel to plate 30, so that the cards may be separately viewed, and any card may then be removed or replaced.

When the cards are placed in position in the holder so as to rest on the longitudinal member 12 the side rails 42, 44 are moved so as to engage the side edges of the cards, the side rails being capable of engaging narrow cards, or wide cards. The end members 48, 50 of the side rails 42, 44 are adapted to clamp and lock on the transverse members 14, 16 by the upper and lower edges of the slots 52 54 engaging the top and bottom faces of the transverse members 14, 16 this locking procedure being similar to that of the plate 38 on the longitudinal member 12. The side rails 4 may then be locked in any position along the transverse members 14, 16 according to the width of the cards. By means of the parallel side rails 42 44, the cards are retained in neat parallel formation in the holder.

It is to be understood that the card holder of this invention may be of any desired length and width and may thus accommodate cards or other articles of a wide variety of sizes.

It will also be appreciated that the longitudinal member 12 and the transverse members 14, 16 may be of any desired cross-section such as circular, oval, triangular, hexagonal, octagonal, polygonal, or other shape and the slot 40 in the plate 38 and the slots 52, 54 in the end members 48 50 of the side rails 42, 44 may be of similar cross-sectional shape to that of the members on which they are movable, or may be of different shape, for example rectangular.

It is to be understood that the above description is by way of example only and that details for carrying the invention into effect may be varied without departing from the scope of the invention claimed.

What I claim is:

1. An adjustable holder for flat articles comprising a frame having a pair of spaced transverse end members and a longitudinal member therebetween whereby said members form an H shape, a fixed first bracket mounted on one said end member and a fixed second bracket mounted on said other end member, a first plate mounted on said first bracket for limited pivotal movement about a generally horizontal plane, a second plate mounted on said longitudinal member, said second plate having an aperture near the lower edge thereof, said aperture being of such shape and dimensions that the plate is readily adjustable longitudinally when placed at right angles to said longitudinal member and is locked against longitudinal movement when tilted such that the upper and lower edges of said aperture engage the upper and lower surfaces of the longitudinal member, and side rails adjustably mounted on said frame for limiting lateral movement of said articles.

2. An adjustable holder for planar articles comprising a frame having a longitudinal base member and a pair of spaced transverse end members said members forming an H shaped frame; at least one end member having an upstanding fixed stop member supporting an angularly adjustable first end plate, a second plate mounted on said longitudinal base member for movement along said longitudinal member towards and away from said first plate, said second plate having an aperture of a shape and dimensions substantially identical with but not less than that of the cross-section of said longitudinal member whereby said second plate may in one position be moved along said member and in another position be locked onto said member to prevent longitudinal movement, a pair of adjustable side rails mounted on said transverse end members for movement in a transverse direction whereby lateral movement of said articles is prevented.

3. An adjustable holder as claimed in claim 2 wherein each said side rail is a substantially inverted U shaped frame having slots or recesses near the ends of the legs thereof for engagement with the respective transverse end members.

4. An adjustable holder as claimed in claim 2 wherein each side rail is a substantially inverted U shaped frame each end of which is provided with a recess adapted to engage the respective transverse end member in such manner as to be adjustably movable along said transverse member when said side rail is placed in a substantially upright position and to be locked against movement when said side rail is tilted laterally to define an acute angle with a vertical longitudinal plane.

5. An adjustable holder for planar articles comprising a base frame having a central longitudinal member of rectangular cross-section and a pair of transverse end members of rectangular cross-section, adjustable means for restraining said articles against longitudinal and lateral movement, said adjustable means comprising a rectangular plate having a rectangular aperture near the lower edge thereof for mounting said plate on said longitudinal member and a pair of side frames of substantially inverted U shape having recesses near the ends thereof for mounting said side frames on said transverse end members, said plate and side frames being so mounted as to be adjustable when brought into an upright position and locked onto their respective members when inclined at an angle to a vertical plane transverse to the direction of adjustment.

6. An adjustable holder according to either claim 1 or claim 2, wherein each side rail is a generally U-shaped member, the legs of the U having recesses in their outer edges which are adapted to engage respective lateral members.

7. An adjustable holder according to claim 5, wherein said recesses are dimension such that the legs of the U are at an angle less than 90° to said lateral members.

8. An adjustable holder according to any one of claims 1 or 2 wherein said end members are rectangular in cross-section.

9. An adjustable holder according to any one of claims 1, 2 or 5, wherein said first and said second brackets are formed from elastic material.

10. An adjustable holder according to any one of claims 1, 2 or 5, wherein said frame members are said first and second brackets are connected by screws or bolts, such that the holder may be readily assembled and disassembled.

* * * * *

UNITED STATES PATENT AND TRADEMARK OFFICE

CERTIFICATE OF CORRECTION

PATENT NO. : 4,198,105

DATED : April 15, 1980

INVENTOR(S) : Bronwen Gibbs

It is certified that error appears in the above—identified patent and that said Letters Patent is hereby corrected as shown below:

At Paragraph [30] the Foreign Application Priority Data should read --August 26, 1977 Australia PD 1416--

Signed and Sealed this

*Twenty-eighth* Day of *October 1980*

[SEAL]

*Attest:*

SIDNEY A. DIAMOND

*Attesting Officer*

*Commissioner of Patents and Trademarks*